US011175620B2

(12) United States Patent
Niikawa

(10) Patent No.: US 11,175,620 B2
(45) Date of Patent: Nov. 16, 2021

(54) IMAGE FORMING APPARATUS

(71) Applicant: CANON KABUSHIKI KAISHA, Tokyo (JP)

(72) Inventor: Yusuke Niikawa, Kanagawa (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 17/142,412

(22) Filed: Jan. 6, 2021

(65) Prior Publication Data

US 2021/0223734 A1 Jul. 22, 2021

(30) Foreign Application Priority Data

Jan. 20, 2020 (JP) ..... JP2020-006953

(51) Int. Cl.
*G03G 15/00* (2006.01)

(52) U.S. Cl.
CPC ..... *G03G 15/757* (2013.01); *G03G 15/5008* (2013.01); *G03G 15/6555* (2013.01)

(58) Field of Classification Search
CPC ..... G03G 15/757; G03G 15/5008; G03G 15/6555
See application file for complete search history.

(56) References Cited

U.S. PATENT DOCUMENTS

2003/0095822 A1* 5/2003 Kamimura ..... G03G 15/6564 399/396
2011/0156336 A1* 6/2011 Agata ..... B65H 7/00 271/3.19
2017/0227903 A1* 8/2017 Kobayashi ..... G03G 15/2028

FOREIGN PATENT DOCUMENTS

JP 06-51576 A 2/1994
JP 2010-140060 A 6/2010

* cited by examiner

*Primary Examiner* — Sandra Brase
(74) *Attorney, Agent, or Firm* — Venable LLP

(57) ABSTRACT

An image forming apparatus includes a drive source, a driving gear provided on an output shaft of the drive source, a first gear engaging with the driving gear, a first drive transmission portion for transmitting a driving force from the first gear to an image bearing member, a second gear engaging with the driving gear, and a second drive transmission portion for transmitting a driving force from the second gear to a feeding portion. The first gear and the second gear are provided coaxially with each other. A positional relationship between the first gear and the second gear with respect to an axial direction is that the first gear is disposed closer to the drive source than the second gear is.

10 Claims, 11 Drawing Sheets

DEVIATION OF EXPOSURE-TRANSFER DISTANCE IN EXPOSURE POSITION FROM INTEGRAL MULTIPLE OF ONE-FULL CIRCUMFERENCE OF MOTOR

IMAGE FORMING APPARATUS

FIELD OF THE INVENTION AND RELATED ART

The present invention relates to an image forming apparatus in which an image formed on an image bearing member is transferred onto a transfer material fed by a feeding means.

In a conventional image forming apparatus, a constitution in which from a latent image formed at an exposure position on a photosensitive drum, a toner image is formed with toner and then is transferred onto a transfer material at a transfer position has been known. In this image forming apparatus, in the case where a driving force from a motor is transmitted to the photosensitive drum by a gear train, a constitution in which when the photosensitive drum rotates in a distance from the exposure position to the transfer position (exposure-transfer distance), a motor rotates in a whole number (integer) of rotations is employed in some instances (Japanese Laid-Open Patent Application (JP-A) 2010-140060).

According to this constitution, even when rotation non-uniformity per rotation of the motor occurs, the influence due to the rotation non-uniformity is absorbed during rotation of the photosensitive drum from the exposure position to the transfer portion, so that an image which does not cause warpage due to the rotation non-uniformity can be obtained.

Further, the motor for driving the photosensitive drum also functions as a driving source for a feeding means for feeding (transport, feeding, fixing, discharge and the like) the transfer material in some instances. In this case, there is a constitution in which a drive transmission path for transmitting a driving force from the motor to the photosensitive drum is provided separately from a drive transmission path for transmitting a driving force from the motor to the feeding means in some instances (JP-A H6-51576).

According to this constitution, the motor is controlled at a certain rotational speed and moment of inertia is large in general. Therefore, even when rotation non-uniformity and a shock fluctuation occur due to a load fluctuation of the feeding means, it is possible to prevent transmission of the rotation non-uniformity and the shock fluctuation to the photosensitive drum.

However, in the above-described conventional constitution, when an exposure device for exposing the photosensitive drum to light is mounted in an apparatus main assembly, there arises an error in mounting position in some instances. In this case, the error in mounting position leads to a deviation in exposure position, so that a distance of the photosensitive drum from the exposure position to the transfer position changes. As a result, the influence of the rotation non-uniformity per rotation of the motor cannot be absorbed, so that there was a liability that image defect due to the rotation non-uniformity occurs.

SUMMARY OF THE INVENTION

A principal object of the present invention is to provide an image forming apparatus capable of satisfactorily absorbing the influence of rotation non-uniformity per rotation of a motor and thus capable of preventing image defect due to the rotation non-uniformity even in the case where a distance of a photosensitive drum from an exposure position to a transfer position changes.

Another object of the present invention is to provide an image forming apparatus capable of preventing transmission, to an image bearing member, of rotation non-uniformity and a shock fluctuation, which occur due to a fluctuation of a load on a feeding means.

According to an aspect of the present invention, there is provided an image forming apparatus in which an image formed on an image bearing member is transferred onto a transfer material fed by feeding means, the image forming apparatus comprising: a drive source; a driving gear provided on an output shaft of the driving source; a first gear engaging with the driving gear; first drive transmission means configured to transmit a driving force from the first gear to the image bearing member; a second gear engaging with the driving gear; and second drive transmission means configured to transmit a driving force from the second gear to the feeding means, wherein the first gear and the second gear are provided coaxially with each other, and wherein a positional relationship between the first gear and the second gear with respect to an axial direction is that the first gear is disposed closer to the driving source than the second gear is.

Further features of the present invention will become apparent from the following description of exemplary embodiments with reference to the attached drawings.

Figure 4:
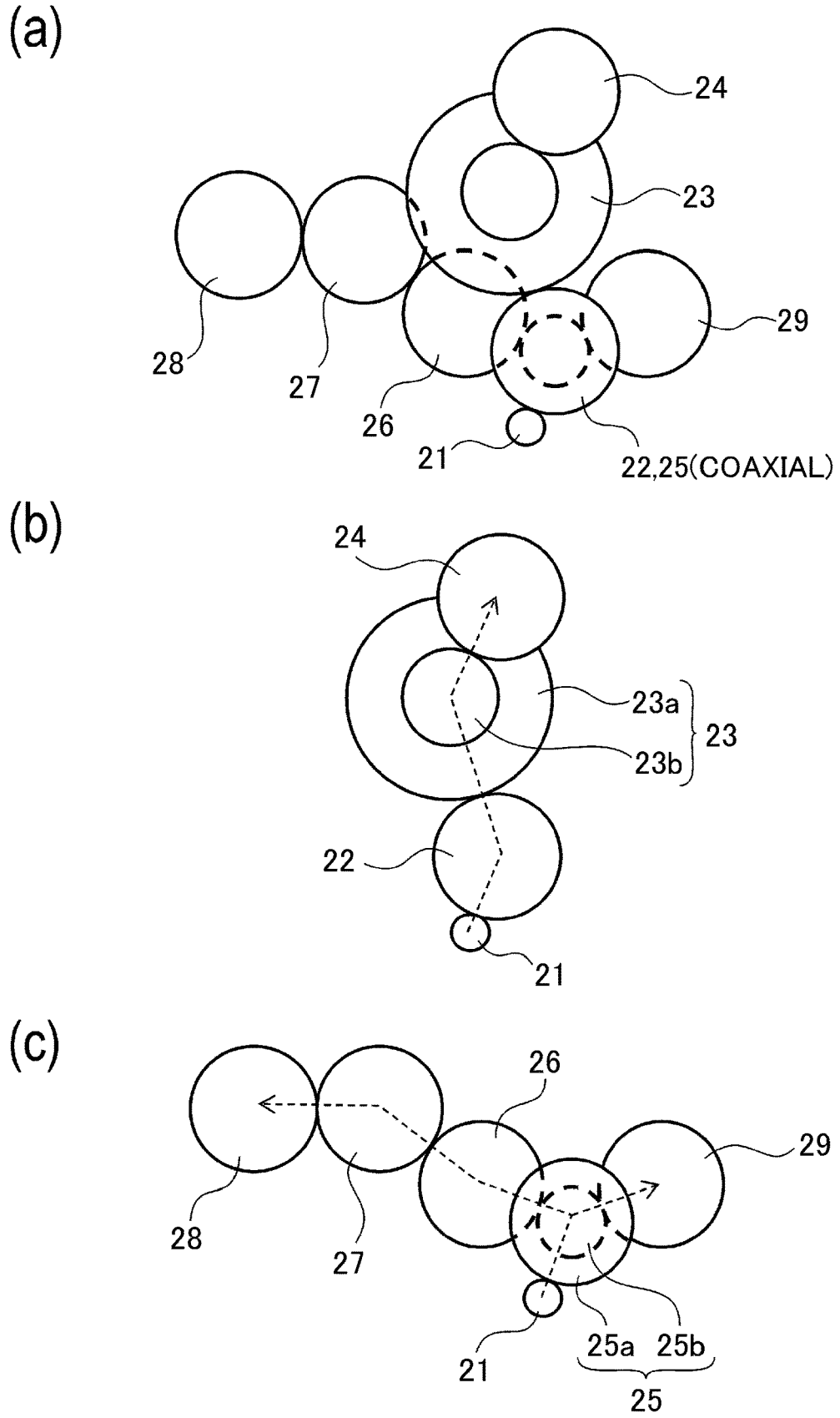

Parts (a) to (c) of FIG. 4 are schematic views of the driving gear train in the embodiment 1.

Figure 5:
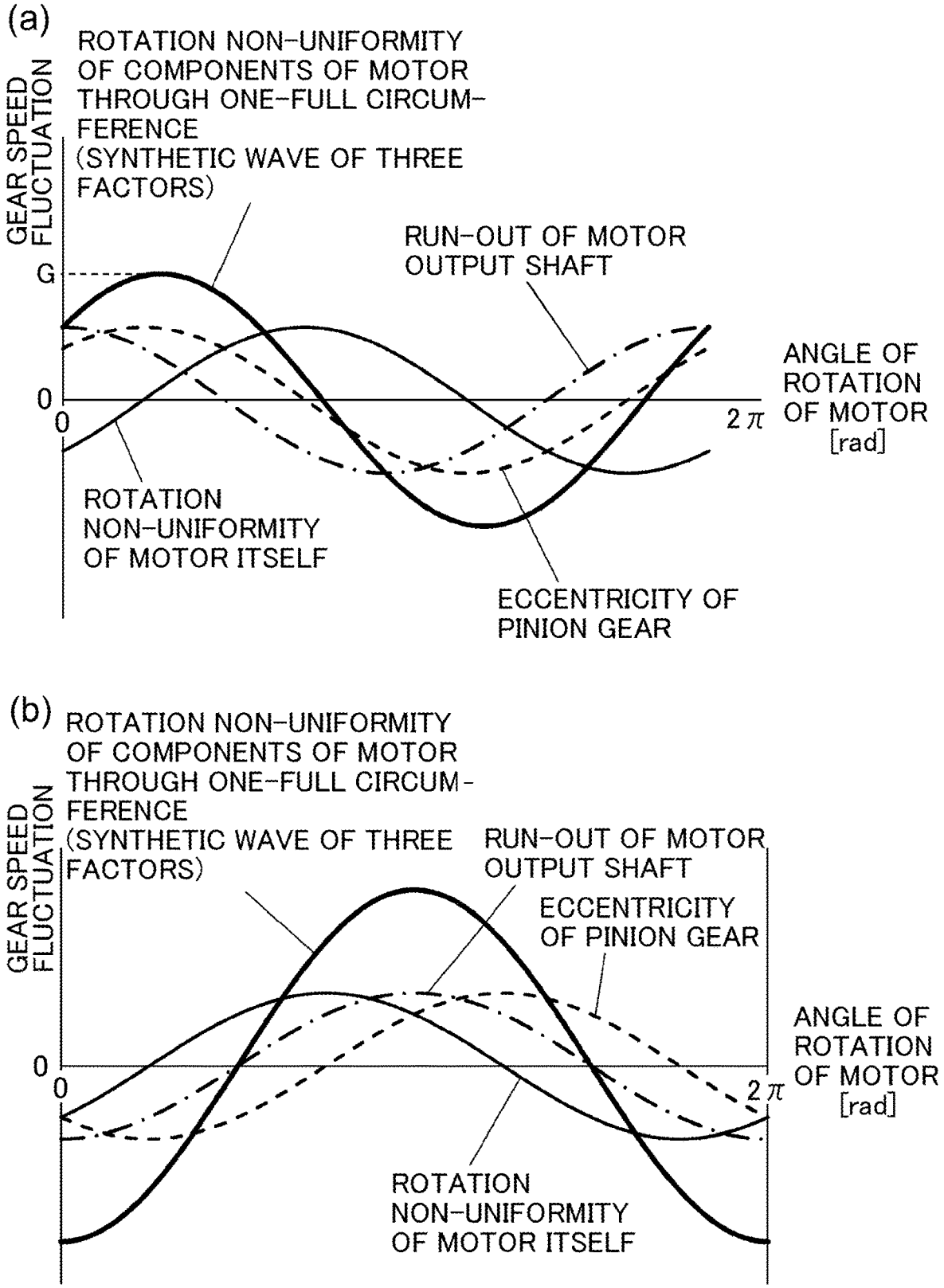

Parts (a) and (b) of FIG. 5 are graphs for illustrating motor rotation non-uniformity in the embodiment 1.

Figure 6:
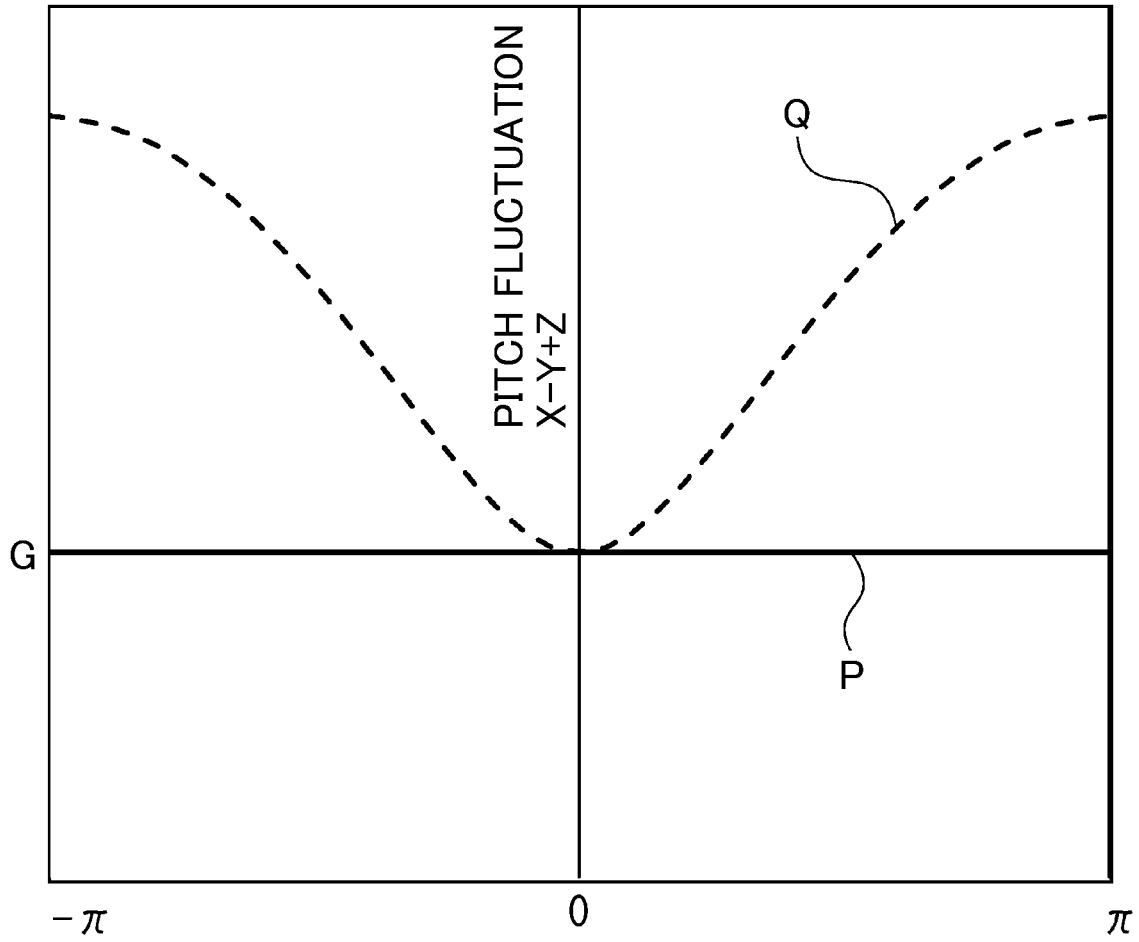

FIG. 6 is a graph for illustrating cancellation of the motor rotation non-uniformity in the embodiment 1.

Figure 7:
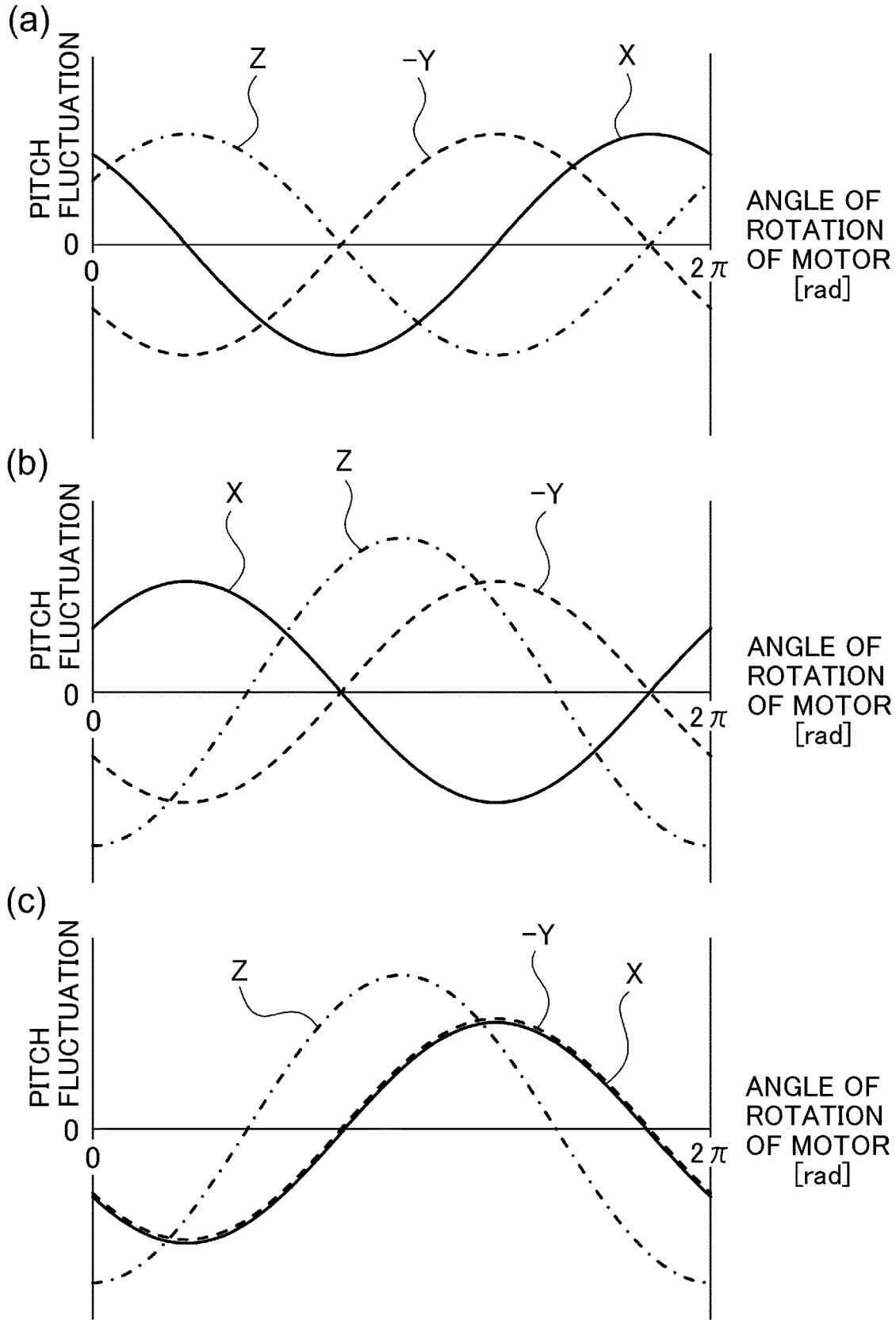

Parts (a) to (c) of FIG. 7 are graphs for illustrating a toner image pitch fluctuation in the embodiment 1.

Figure 8:
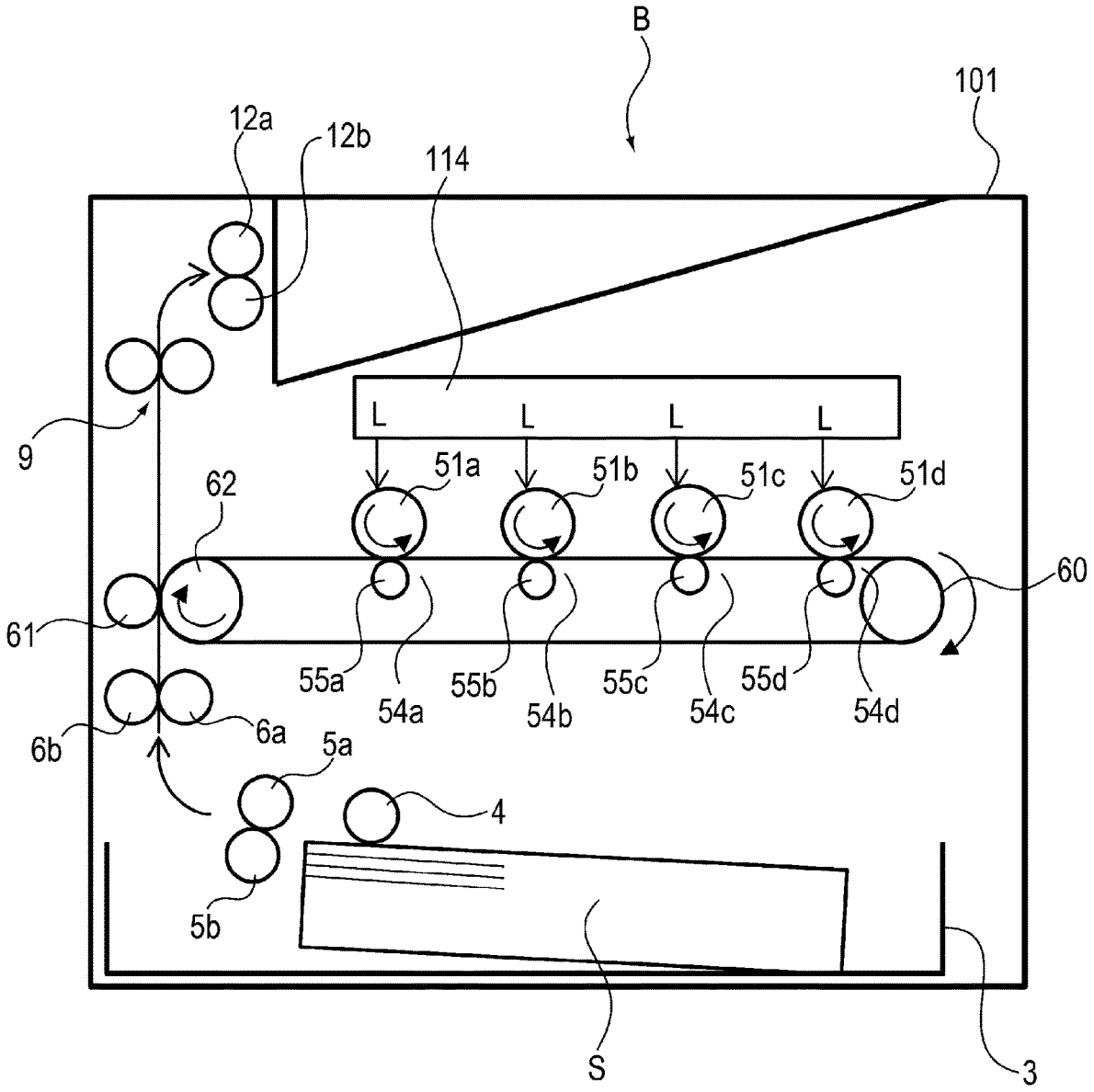

FIG. 8 is a schematic view of an inside structure of an image forming apparatus according to an embodiment 2.

Figure 9:
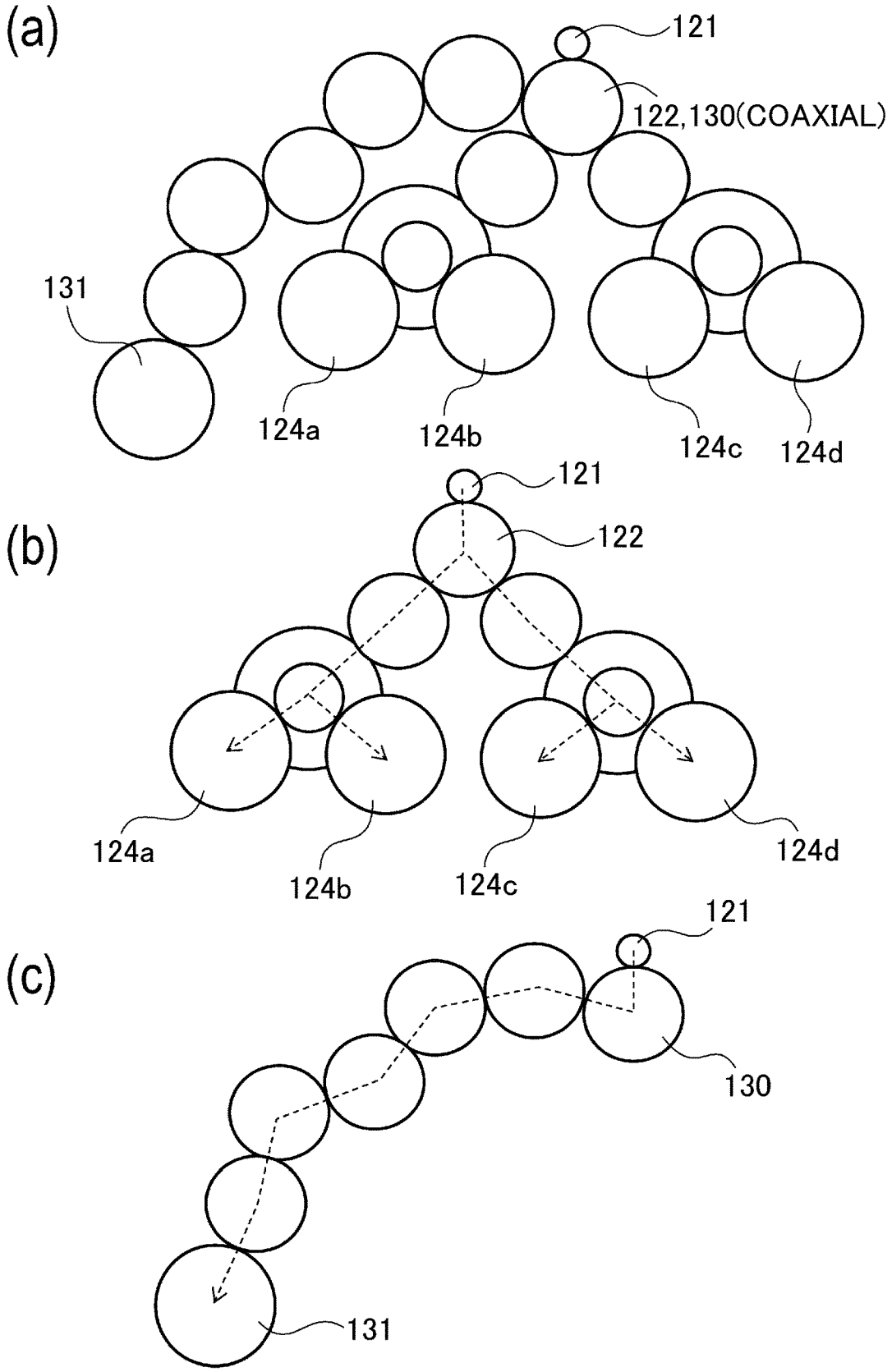

Parts (a) to (c) of FIG. 9 are schematic views of a driving gear train in the embodiment 2.

Figure 10:
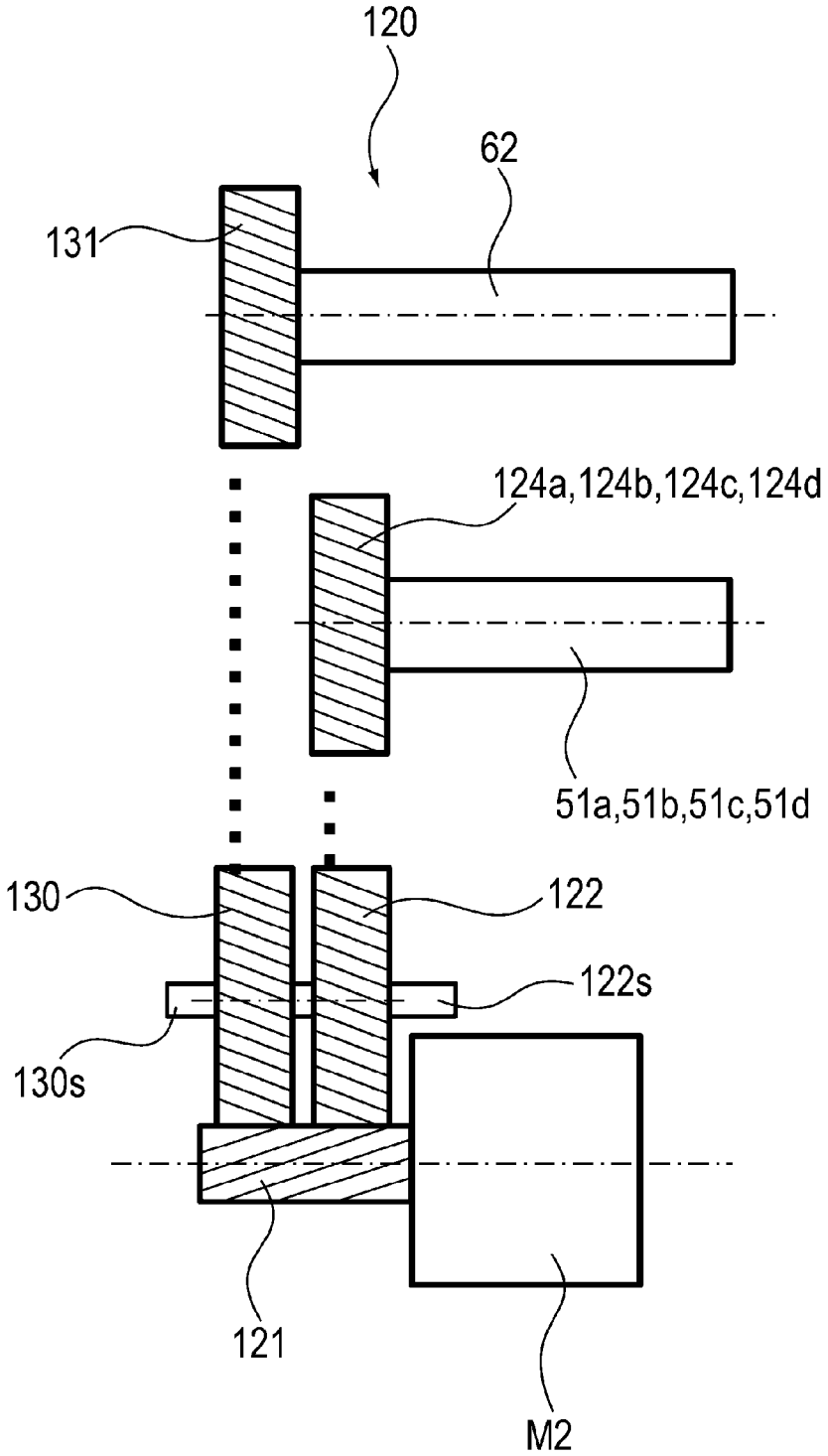

FIG. 10 is a side view of the driving gear train in the embodiment 2.

Figure 11:
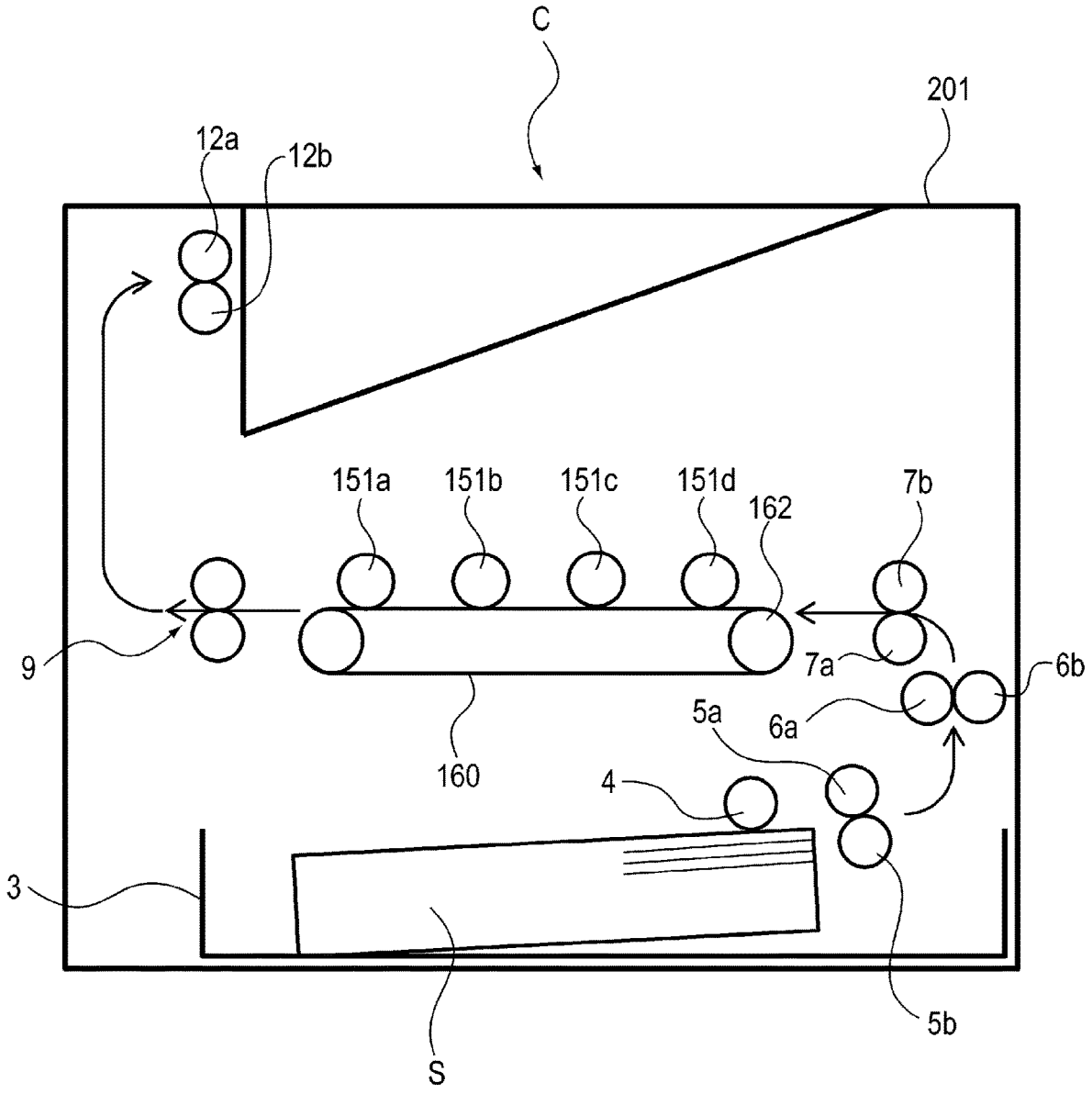

FIG. 11 is a schematic view of an inside structure of another image forming apparatus according to the embodiment 2.

DESCRIPTION OF THE EMBODIMENTS

Embodiments of the present invention will be specifically described with reference to the drawings. Dimensions, materials, shapes and relative arrangement of constituent elements described in the following embodiments should be appropriately changed depending on structures and various conditions of image forming apparatuses to which the present invention is applied, and the scope of the present invention is not intended to be limited thereto.

Embodiment 1

Figure 1:
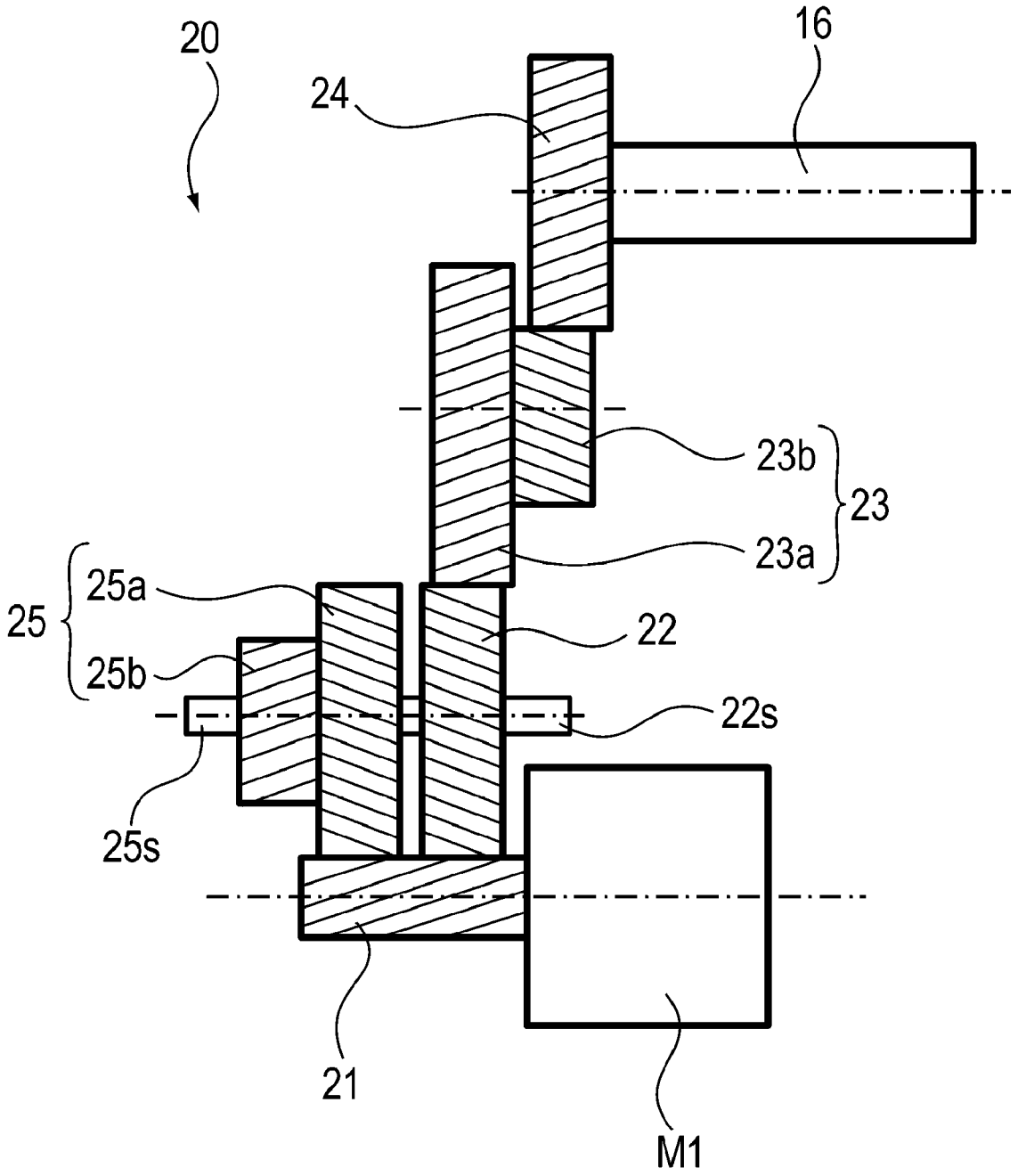
FIG. 1 is a side view of a driving gear train in an embodiment 1.
Figure 2:
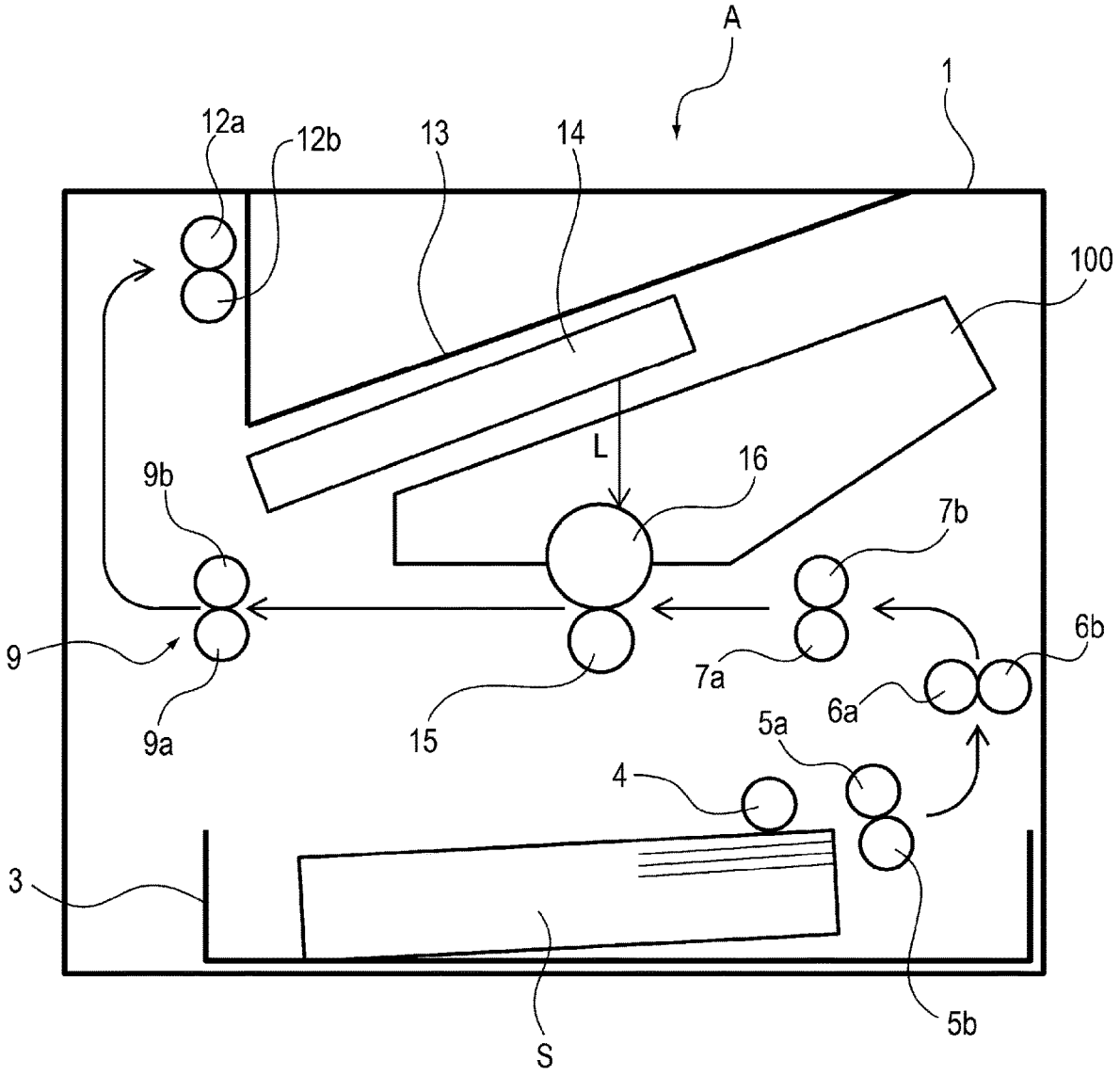
FIG. 2 is a schematic view of an inside structure of an image forming apparatus according to the embodiment 1.

A general structure of an image forming apparatus according to an embodiment 1 of the present invention will be described using FIG. 2. FIG. 2 is a schematic view of an inside structure of the image forming apparatus according to the embodiment 1. As shown in FIG. 2, an image forming apparatus A of this embodiment is a monochromatic laser beam printer of an electrophotographic type. An apparatus main assembly of the image forming apparatus A includes an optical scanner 14, a photosensitive drum 16 as an image bearing member, a feeding means for feeding a recording material (medium) S, such as recording paper, an OHP sheet or a cloth, as a transfer material, and a drive transmission mechanism 20 (FIG. 1) for driving the photosensitive drum 16 and the feeding means. The drive transmission mechanism 20 will be described later.

The feeding means comprises feeding rollers which are provided downstream or upstream of a transfer position, where an image formed on the photosensitive drum 16 is transferred onto the recording material S, with respect to a feeding direction of the recording material S and which relate to feeding of the recording material S in the transfer position. The feeding rollers provided upstream of the transfer position with respect to the recording material feeding direction are a pick-up roller 4, a feeding roller pair 5*a* and 5*b*, a feeding roller pair 6*a* and 6*b*, and a registration roller pair 7*a* and 7*b*, and are transporting means for transporting (feeding) the recording material S, stacked in a cassette 3 which is a stacking portion, to the transfer position. The feeding rollers provided downstream of the transfer position with respect to the recording material feeding direction are a pressing roller 9*a* and a heating roller 9*b* of a fixing means 9 for fixing, on the recording material S, the image transferred on the recording material S in the transfer position.

The photosensitive drum 16 as the image bearing member is assembled together with at least one of process means actable on the photosensitive drum 16 into a cartridge as a process cartridge 100, which is constituted so as to be mountable to and dismountable from the apparatus main assembly 1 of the image forming apparatus 1. In this embodiment, the process cartridge 100 includes, as the process means, a charging roller 17 (FIG. 3) as a charging means for electrically charging the photosensitive drum 16, and a developing roller 18 (FIG. 3) as a developing means for developing a latent image, formed on the photosensitive drum 16, with a developer (toner in this embodiment).

An operation of the image forming apparatus A will be briefly described. In the image forming apparatus A, the latent image is formed on a photosensitive layer of the photosensitive drum 16 by irradiating the photosensitive drum 16 as the image bearing member with laser light L based on image information from the optical scanner 14. This latent image is developed with the toner as the developer, so that a developer image (toner image) is formed on the photosensitive drum 16.

Then, in synchronism with formation of the toner image, the recording material S stacked in the cassette 3, which is the stacking portion, is fed to the transfer position by the pick-up roller 4, the feeding roller pair 5*a* and 5*b*, the feeding roller pair 6*a* and 6*b*, and the registration roller pair 7*a* and 7*b*. A voltage is applied to a transfer roller 15 as a transfer means, whereby the toner image formed on the photosensitive drum 16 is transferred from the photosensitive drum 16 onto the recording material S. Then, the recording material S on which the toner image has been transferred is fed to the fixing means 9, and is heated and pressed by the pressing roller 9*a* and the heating roller 9*b* of the fixing means 9, so that the toner image is fixed. Then, the recording material S on which the toner image is fixed is discharged onto an outside discharge tray 13 by a discharging roller pair 12*a* and 12*b*.

Figure 3:
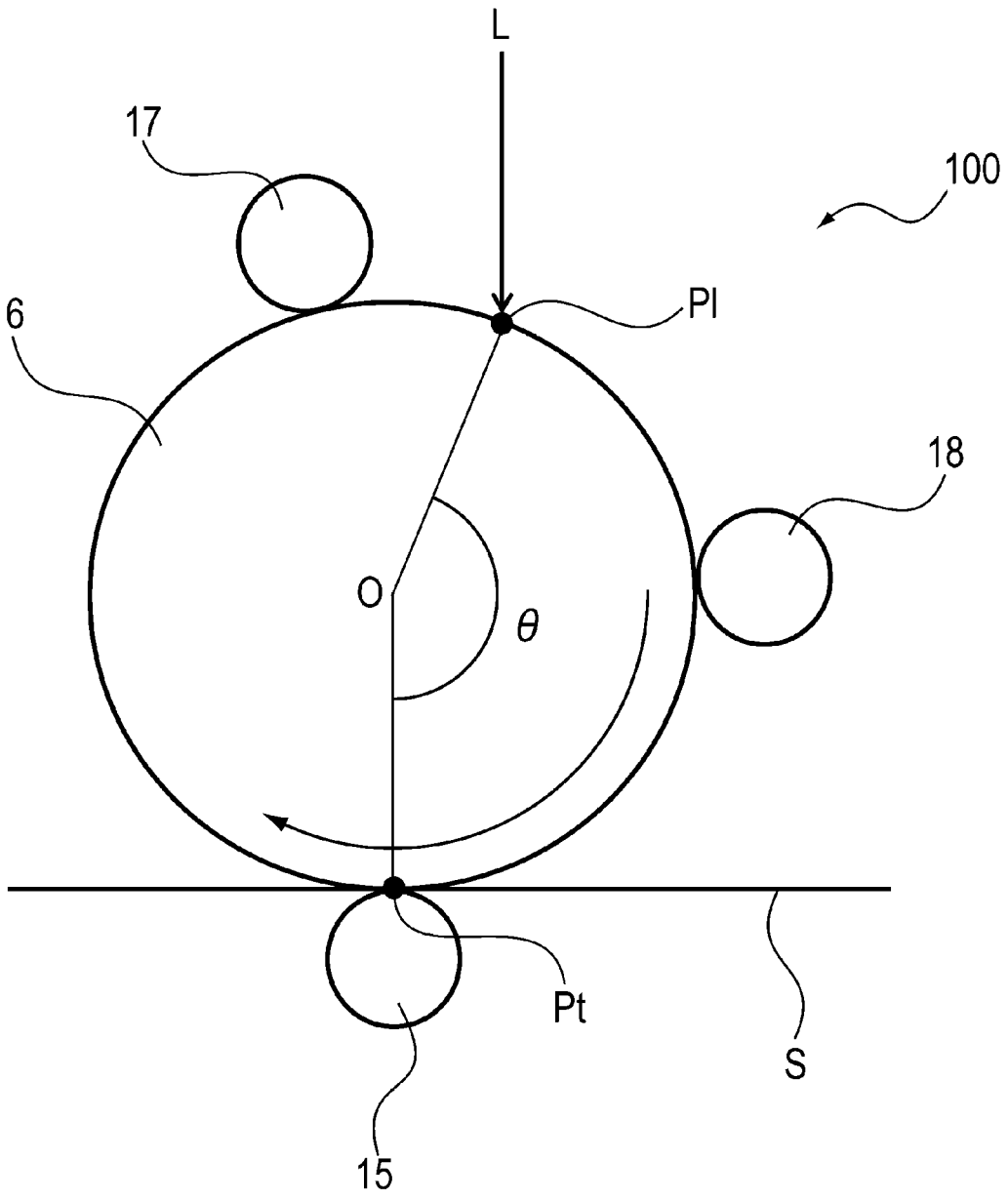
FIG. 3 is a schematic view of a photosensitive drum and a periphery thereof in the embodiment 1.

Next, by using FIG. 3, an exposure position Pl and a transfer position Pt of the photosensitive drum 16 will be described. FIG. 3 is a schematic view of the photosensitive drum 16 and a periphery of the photosensitive drum 16 in the embodiment 1.

The photosensitive drum 16 rotates clockwise in an arrow direction. A position on which the laser light L from the optical scanner 14 is incident is the exposure position Pl, and a position where the developer image (toner image) is transferred from the photosensitive drum 16 onto the recording material S, which is a transfer material, is the transfer position Pt. Further, an angle Pl-O-Pt formed between a rectilinear line connecting a rotation center of the photosensitive drum 16 and the exposure position Pl and a rectilinear line connecting the rotation center and the transfer position Pt (hereinafter, referred to as an exposure-transfer angle (angle between exposure position and transfer position)) is θ. Here, the exposure-transfer angle θ is determined under constraints of the constitution of the image forming apparatus A, and in this embodiment, the exposure-transfer angle θ is 169°. A distance on a peripheral surface of the photosensitive drum 16 between the exposure and transfer positions, i.e., between the exposure position Pl and the transfer position Pt, is called an exposure-transfer distance in the following.

Feeding of the recording material S at the transfer position Pt where the photosensitive drum 16 and the transfer roller 15 are opposed to each other is carried out by the feeding means. The feeding means comprises, as described above, the feeding rollers relating to the feeding of the recording material P at the transfer position Pt, and are constituted by the fixing means 9 and the rollers (4, 5*a*, 5*b*, 6*a*, 6*b*, 7*a* and 7*b*) shown in FIG. 2. For that reason, a feeding speed of the recording material S at the transfer position Pt is controlled by the feeding means.

Next, by using FIGS. 1 and 4, a structure of a drive transmission mechanism 20 for the photosensitive drum 16 and the feeding means will be described. FIG. 1 is a side view of a driving gear train which is the drive transmission mechanism 20 in the embodiment 1. Parts (a) to (c) of FIG. 4 are schematic views of the driving gear train in the embodiment 1.

In this embodiment, by a single motor M1 which is a driving source, the photosensitive drum 16 and the feeding means are driven. The schematic views of the gear train for driving the photosensitive drum 16 and the feeding means by the single motor M1 are shown in parts (a) and (b) of FIG. 4. Part (a) of FIG. 4 is the schematic view of entire driving gear train, part (b) of FIG. 4 is an extracted view, from part (a) of FIG. 4, of the gear train for driving the photosensitive drum 16, and part (c) of FIG. 4 is an extracted view, from part (a) of FIG. 4, of the gear train for driving the feeding means.

The drive transmission mechanism 20 includes the single motor M1 which is the driving source, and a pinion gear 21 which is a driving gear provided on an output shaft of the motor M1. The drive transmission mechanism 20 further includes a first idler gear 22 which is a first gear engaging with the pinion gear 21, and a first stepped gear 23 which is a first drive transmission means for transmitting a driving force from the first idler gear 22 to the photosensitive drum 16. Further, the drive transmission mechanism 20 includes a second stepped gear 25 which is a second gear engaging with the pinion gear 21, a second idler gear 26, a third idler gear 27 and a fourth idler gear 29 which are second drive transmission means for transmitting a driving force from the second stepped gear 25 to the feeding rollers.

First, the gear train for driving the photosensitive drum 16 will be described using part (b) of FIG. 4 and FIG. 1. The pinion gear 21 is mounted integrally with the output shaft of the motor M1. The first idler gear 22 engages with the pinion gear 21 and is freely rotatable relative to a rotation shaft 22*s*. A drum driving gear 24 is a gear mounted integrally with the photosensitive drum 16 which is an object to be driven shown in FIG. 2. The drum driving gear 24 engages with the first idler gear 22 through the first stepped gear 23. Specifically, the drum driving gear 24 engages with a small gear portion 23*b* of the first stepped gear 23, and a large gear portion 23*a* of the first stepped gear 23 engages with the first idler gear 22.

Here, the number of teeth which is one of specifications of each of the gears of the gear train for driving the photosensitive drum 16 is set as follows. The number of teeth of the pinion gear 21 is set at 13 teeth. The number of teeth of the first idler gear 22 is set at 65 teeth. The number of teeth of the large gear portion 23*a* of the first stepped gear 23 is set at 92 teeth, and the number of teeth of the small gear portion 23*b* of the first stepped gear 23 is set at 60 teeth. The number of teeth of the drum driving gear 24 is set at 90 teeth.

From the above specifications, a speed reduction ratio n1 of the gear train from the motor M1 to the photosensitive drum 16 can be calculated by the following formula:

$$\text{Reduction ratio } n1 = 13/92 \times 60/90 = 0.0942.$$

Next, the gear train for driving the feeding means will be described using part (c) of FIG. 4 and FIG. 1. As regards the second stepped gear 25, a large gear portion 25*a* engages with the pinion gear 21 and is freely rotatable relative to a rotation shaft 25*s*. Here, the large gear portion 25*a* of the second stepped gear 25 is identical in specifications such as the number of teeth and a module to those of the first idler gear 22 described above. Further, the rotation shaft 25*a* of the second stepped gear 25 is disposed coaxially with the rotation shaft 22*s* of the first idler gear 22. A pressing roller gear 28 is a gear provided integrally with the pressing roller 9*a*, of the fixing means 9, which is the feeding roller as an object to be driven as shown in FIG. 2. The pressing roller gear 28 engages with the small gear portion 25*b* of the second stepped gear 25 through the second idler gear 26 and the third idler gear 27. Specifically, the pressing roller gear 28 engages with the third idler gear 27. The third idler gear 27 engages with the second idler gear 26. The second idler gear 26 engages with the small gear portion 25*b* of the second stepped gear 25.

Further, the fourth idler gear 29 is a gear engaging with the small gear portion 25*b* of the second stepped gear 25. The gear train for transmitting the driving force to the pick-up roller 4, the feeding roller pair 5*a* and 5*b*, the feeding roller pair 6*a* and 6*b*, and the registration roller pair 7*a* and 7*b*, which are the feeding rollers branches from the above-described second to fourth idler gears 26, 27 and 29 and the pressing roller gear 28 (not shown).

A positional relationship, with respect to an axial direction of the rotation shafts 22*s* and 25*s* of the first and second stepped gears 22 and 25, which are the first and second gears, respectively, is such that as shown in FIG. 1, the first idler gear 22 is disposed closer to the motor M1, which is the driving source, than the second stepped gear 25 is.

Next, an operation of the motor M1 as to how to transfer rotation non-uniformity per rotation, generated in the motor M1, to the recording material S which is the transfer material will be described using FIGS. 5 to 7. Parts (a) and (b) of FIG. 5 are graphs for illustrating the rotation non-uniformity of the motor M1 in the embodiment 1. Incidentally, in parts (a) and (b) of FIG. 5, the rotation non-uniformity per rotation generated in the motor M1 is represented by rotation non-uniformity of components of the motor through one-full circumference. FIG. 6 is a graph for illustrating cancellation of the rotation non-uniformity of the motor in the embodiment 1. Parts (a) to (c) of FIG. 7 are graphs for illustrating a pitch fluctuation of the toner image in the embodiment 1.

The rotation non-uniformity per rotation of the motor M1 transmitted to the photosensitive drum 16 principally includes three (first to third) factors. The first factor is rotation non-uniformity (WOW) of the motor M1 itself. The second factor is run-out of the output shaft of the motor M1. The third factor is eccentricity of the pinion gear 21. Incidentally, in general, a speed fluctuation of the gear is in the form of a sine wave in many instances. Also, in this embodiment, the gear speed fluctuation conforms thereto.

A profile of the rotation non-uniformity, per rotation of the motor, of the first idler gear 22 is shown as an example in part (a) of FIG. 5. A waveform of the rotation non-uniformity per rotation of the motor is a synthetic wave of three waveforms of the rotation non-uniformity of the motor M1 itself, the run-out of the output shaft and the eccentricity of the pinion gear 21. An amplitude of this synthetic wave is G. Phases of three elemental sine waves change depending on manufacturing variations of the motor M1, a mounting phase of the pinion gear 21 to the output shaft of the motor M1, and the like. The output shaft 25*s* of the second stepped gear 25 is coaxial with the rotation shaft 22*s* of the first idler gear 22. Accordingly, as shown in FIG. 4, the first idler gear 22 and the large gear portion 25*a* of the second stepped gear 25 are equal in engagement phase with the pinion gear 21 to each other. As a result, a profile of rotation non-uniformity, per rotation of the motor, of the second stepped gear 25 is the same as the profile of the first idler gear 22.

As shown in FIGS. 1 and 4, the rotation non-uniformity per rotation of the motor, transmitted from the motor M1 to the first idler gear 22 is transmitted to the photosensitive drum 16 through the first stepped gear 23 and the drum driving gear 24. Further, the rotation non-uniformity per rotation of the motor, transmitted from the motor M1 to the second stepped gear 25 is similarly transmitted to the feeding means.

A mechanism in which the rotation non-uniformity per rotation of the motor is transferred (transmitted) to the toner image on the recording material S will be described using FIG. 3.

First, in the exposure position Pl of the photosensitive drum 16, the latent image is formed on the photosensitive layer of the photosensitive drum 16 by irradiating the photosensitive drum 16 with the laser light L from the optical scanner 14. At this time, due to the rotation non-uniformity per rotation of the motor, a pitch of the latent image changes. For example, when a speed of the motor M1 increases, the pitch of the latent image on the photosensitive drum 16 with respect to a rotational direction expands. A speed fluctuation of the photosensitive drum 16 in the exposure position Pl is X.

Thereafter, the latent image formed on the photosensitive drum 16 is developed by the developing roller 18 with the toner which is the developer. Then, in the transfer position Pt of the photosensitive drum 16, the toner image formed on the photosensitive drum 16 is transferred onto the recording material S. At this time, due to the rotation non-uniformity per rotation of the motor, a peripheral speed of the photosensitive drum 16 in the transfer position Pt changes, so that the pitch of the toner image on the recording material S changes. For example, when the speed of the motor M1 increases, the pitch of the toner image with respect to the rotational direction of the photosensitive drum 16 becomes narrow. A speed fluctuation of the photosensitive drum 16 in the transfer position Pt is Y.

In the transfer position Pt, simultaneous with occurrence of the pitch change by the photosensitive drum 16, a fluctuation of a feeding speed per rotation of the motor, of the recording material S by the feeding means occurs. For example, when the speed of the motor M1 increases, the pitch of the toner image with respect to the feeding direction of the recording material S expands. A speed fluctuation of the recording material S in the transfer position Pt is Z.

A pitch fluctuation of the toner image transferred on the recording material S is superposition of the above-described three elements (factors), and is represented by X−Y+Z. In part (a) of FIG. 7, a pitch fluctuation profile of the toner image transferred on the recording material S is shown. As described above, the profile of the rotation non-uniformity per rotation of the motor, of the second stepped gear 25 is the same as the profile of the first idler gear 22. For that reason, the speed fluctuation Y of the photosensitive drum 16 due to the rotation non-uniformity per rotation of the motor in the transfer position Pt is equal to the speed fluctuation Z of the recording material S due to the rotation non-uniformity per rotation of the motor in the transfer position Pt, so that Y=Z holds. For that reason, the pitch fluctuation of the toner image transferred on the recording material S is represented by X−Y+Z=X. That is, as regards the influence of the rotation non-uniformity per rotation of the motor, the speed fluctuation Y of the photosensitive drum 16 in the transfer position Pt and the speed fluctuation Z of the recording material S in the transfer position Z are canceled to each other, so that only the speed fluctuation X of the photosensitive drum 16 in the exposure position Pl remains. Incidentally, the speed fluctuation X of the photosensitive drum 16 in the exposure position Pl and the speed fluctuation Y of the photosensitive drum 16 in the transfer position Pt are waveforms which are deviated in phase from each other only by the exposure-transfer distance (exposure-transfer angle θ) and which are equal in amplitude and cyclic period to each other. The waveform X shown in part (a) of FIG. 7 is the waveform of the rotation non-uniformity of a one-full circumference component of the motor shown in part (a) of FIG. 5, and the amplitude G is constant irrespective of the exposure-transfer distance.

FIG. 6 shows a graph in which the influence of the rotation non-uniformity per rotation of the motor is canceled. The abscissa of the graph shown in FIG. 6 represents an exposure position deviation from an original at which an image of one-full circumference of the motor in the exposure-transfer distance on the photosensitive drum 16 is plotted. A maximum (value) 7C represents an exposure position deviation corresponding to half of the one-full circumference of the motor. The ordinate of the graph of FIG. 6 represents the amplitude of the pitch fluctuation X−Y+Z transferred onto the recording material S.

First, in FIG. 6, a curve Q indicated by a broken line as an object to be compared (conventional example) is shown. The curve Q is a curve in the case where the first idler gear 22 and the second stepped gear 25 are disposed on opposite sides from each other with respect to the pinion gear 21. In this case, with respect to the profile of the rotation non-uniformity per rotation of the motor, of the first idler gear 22, the second stepped gear 25 is deviated in phase of 180° in terms of the run-out of the output shaft and the eccentricity of the pinion gear 21 of the three elements of the rotation non-uniformity per rotation of the motor, as shown in part (b) of FIG. 5. This is because the first idler gear 22 and the second stepped gear 25 are disposed on the opposite sides with respect to the pinion gear 21. For this reason, the profile of the rotation non-uniformity per rotation of the motor, of the second stepped gear 25 shown in part (b) of FIG. 5 is different from the profile of the first idler gear 22 shown in part (a) of FIG. 5. As a result, the speed fluctuation Y of the photosensitive drum 16 and the speed fluctuation Z of the recording material S, which are due to the rotation non-uniformity per rotation of the motor in the transfer position Pt, are different from each other. Waveforms relating to the pitch fluctuation X−Y−Z, which is transferred on the recording material S shown in part (b) of FIG. 5, are synthesized, and then the amplitude of the synthesized wave is calculated, so that a resultant curve is the curve Q indicated by the broken line in FIG. 6.

When the exposure-transfer distance of the photosensitive drum 16 is an integer multiple of the one-full circumference of the motor, the speed fluctuations X and Y in the exposure position Pl and the transfer position Pt, respectively, become equal to each other. For that reason, X=Y holds, and as shown in part (b) of FIG. 7, for the pitch fluctuation X−Y+Z, only Z remains. When the exposure-transfer distance deviates from the integer multiple of the one-full circumference of the motor, the influence of the rotation non-uniformity per rotation of the motor cannot be absorbed, so that the amplitude of the pitch fluctuation X−Y+Z becomes large. In part (c) of FIG. 7, a graph when the exposure-transfer distance deviates from the image of the one-full circumference of the motor by half of the one-full circumference of the motor is shown as an example.

On the other hand, a curve P is a curve in the case where the first idler gear 22 and the second stepped gear 25, which are constituent elements of this embodiment, are coaxial with each other. As described above, even in the case where the exposure position deviation occurs, the amplitude of the pitch fluctuation X−Y+Z is constant. In the case where the exposure-transfer distance deviates from the image of the one-full circumference of the motor, it is understood that the curve P is smaller in amplitude than the curve Q and the influence of the rotation non-uniformity per rotation of the motor is satisfactorily absorbed.

Incidentally, in both the curves P and Q shown in FIG. 6, a magnitude of the amplitude (ordinate) of each curve changes by a phase relationship between the run-out of the output shaft of the motor M1 and the eccentricity of the pinion gear 21 relative to the rotation non-uniformity (WOW) of the motor M1 itself. In each of the curves shown in FIG. 6, phases at which the amplitude (ordinate) becomes maximum is extracted and plotted.

Further, the first idler gear 22 for driving the photosensitive drum 16 and the second stepped gear 25 for driving the feeding means branch from the pinion gear 21 mounted integrally with the output shaft of the motor M1. For that reason, it becomes possible to prevent the rotation non-uniformity and the shock fluctuation caused by a load fluctuation of the feeding means from transmitting to the photosensitive drum 16.

As described above, even in the case where the exposure-transfer distance changes due to an error in mounting position of the optical scanner 14, the influence of the rotation non-uniformity per rotation of the motor is satisfactorily absorbed, so that image defect such as image distortion due to the rotation non-uniformity can be prevented. Further, the rotation non-uniformity and the shock fluctuation caused by the load fluctuation of the feeding means can be prevented from transmitting to the drive of the photosensitive drum 16.

Here, there is no need that gear specifications, such as the module, number of teeth, angle of torsion, displacement amount, angle of obliquely, and the like, of the first idler gear 22 and the large gear portion 25*a* of the second stepped gear 25 are not always the same. The gear specifications may only be required so that the pinion gear 21 is formed in a stepped gear and that a center distance between the pinion gear 21 and the first idler gear 22 and a center distance between the pinion gear 21 and the large gear portion 25*a* of the second stepped gear 25 are equal to each other. However, when the gear specifications of the first idler gear 22 and the gear specifications of the large gear portion 25*a* of the second stepped gear 25 are made equal to each other, there is no need to constitute the pinion gear 21 as the stepped gear, so that there is no deviation in eccentric phase between the gears of the stepped gear. For that reason, an eccentric component of the pinion gear 21 can be more effectively canceled.

Further, of the rotation non-uniformity per rotation of the motor, the run-out of the output shaft of the motor M1 is smaller on a base side than on a free end side of the motor shaft of the motor M1. For that reason, it is preferable that in order to reduce the rotation non-uniformity of the photosensitive drum 16, the first idler gear 22 for driving the photosensitive drum 16 is disposed closer to the motor M1 than the second stepped gear 25 for driving the feeding means is.

When the rotation non-uniformity per rotation of the motor for the feeding means changes in amplitude relative to the photosensitive drum 16 or deviates in phase during transmission thereof through the gear train, the pitch fluctuation X−Y+Z somewhat deviates from a constant amplitude in some cases. However, in this embodiment, a speed reduction ratio n1 of the gear train from the motor M1 to the photosensitive drum 16 is 0.0942, and the exposure-transfer angle θ is 169°. For that reason, the distance from the exposure position Pl to the transfer position Pt is an integer multiple N1 of the one-full circumference of the motor M1, satisfying a relationship of $1/n1\times\theta/360\approx N1$ (N1: natural number). That is, the exposure-transfer distance is $1/n1\times\theta/360=1/0.0942\times169/360=4.98\approx5$ times the one-full circumference of the motor, i.e., an integer multiple of the one-full circumference of the motor. For that reason, even in the case where the pitch fluctuation X−Y+Z deviates from the constant amplitude, the influence of rotation non-uniformity per (one) rotation (one-full circumference component) of the motor can be satisfactorily absorbed between the exposure position and the transfer position.

The rollers constituting the feeding means are rollers (or the transfer roller 15) which are disposed upstream or downstream of the transfer position Pt with respect to the feeding direction of the recording material S. In this embodiment, the rollers 4, 5*a*, 5*b*, 6*a*, 6*b*, 7*a*, 7*b* and the like, which are upstream-side rollers, and the rollers 9*a* and 9*b* of the fixing means 9, which are downstream-side rollers, constitute the feeding means. The feeding speed of the recording material S in the transfer position Pt is reliably controlled by the feeding means and therefore control of such is preferred.

Further, in this embodiment, the case where the gears such as the pinion gear 21 are helical gears as shown in FIG. 1 are described as an example, but may also be spur gears, for example.

Embodiment 2

Next, an image forming apparatus according to an embodiment 2 of the present invention will be described using FIG. 8. FIG. 8 is a schematic view of an inside structure of the image forming apparatus according to the embodiment 2. In this embodiment, only a characteristic portion of the image forming apparatus is described, and other constitution and actions of the image forming apparatus are the same as those in the image forming apparatus in the embodiment 1. Therefore, portions identical or similar to those of the image forming apparatus in the embodiment 1 are represented by the same reference numerals or symbols and will be omitted from description.

As shown in FIG. 8, an image forming apparatus B of this embodiment is a full-color laser beam printer of an electrophotographic type. An apparatus main assembly 101 of the image forming apparatus B includes an optical scanner 114 and four image forming portions 54*a*, 54*b*, 54*c* and 54*d*. In this embodiment, constitutions and actions of the image forming portions 54*a*, 54*b*, 54*c* and 54*d* are substantially the same except that colors of toners used are different from each other. The image forming portions 54*a*, 54*b*, 54*c* and 54*d* include photosensitive drums 51*a*, 51*b*, 51*c* and 51*d*, respectively, as image bearing members and include process means (not shown) such as charging means and developing means.

Further, the apparatus main assembly 101 of the image forming apparatus B includes an intermediary transfer belt 60 as an intermediary transfer member for once carrying images formed on the respective photosensitive drums. The intermediary transfer belt 60 is an endless belt stretched by a plurality of stretching members. The intermediary transfer belt 60 is rotationally driven by a belt driving roller 62 which is one of the stretching members and is circulated and moved while opposing the respective image forming portions. Further, in opposing positions to the photosensitive drums, primary transfer rollers 55*a*, 55*b*, 55*c* and 55*d* which are transfer means are provided through the intermediary transfer belt 60.

Further, the toner images formed on the photosensitive drums 51 are successively transferred superposedly by the primary transfer rollers 55 opposing the photosensitive drums 51 onto the intermediary transfer belt 60 circulating and moving while opposing the image forming portions, and are once carried on the intermediary transfer belt 60. In synchronism therewith, the recording material S stacked in the cassette 3, which is the stacking portion, is fed to a secondary transfer position by the pick-up roller 4, the feeding roller pair 5*a* and 5*b*, the feeding roller pair 6*a* and 6*b*, and the registration roller pair 7*a* and 7*b*. The toner images carried on the intermediary transfer belt 60 are collectively secondary-transferred by a secondary transfer roller 61 which is a secondary transfer means, onto the recording material S fed to the secondary transfer position. Then, the recording material S on which the toner image has been transferred is fed to the fixing means 9, and is heated and pressed by the fixing means 9, so that the toner image is fixed. Then, the recording material S on which the toner image is fixed is discharged onto an outside discharge tray 13 by a discharging roller pair 12*a* and 12*b*.

Next, by using FIGS. 9 and 10, a structure of a drive transmission mechanism 20 for the photosensitive drum 16 and the feeding means will be described. Parts (a) to (c) of FIG. 9 are schematic views of a driving gear train which is the drive transmission mechanism 20 in the embodiment 2. FIG. 10 is a side view of the driving gear train in the embodiment 2.

In this embodiment, the image bearing members are the photosensitive drums 51 (51*a*, 51*b*, 51*c*, 51*d*), the feeding means is the belt driving roller 62, and the transfer material fed by the feeding means is the intermediary transfer belt 60.

In this embodiment, a single motor M2 as a driving source can rotate the four photosensitive drums 51*a*, 51*b*, 51*c* and 51*d* and the intermediary transfer belt 60. The schematic views of the gear train for driving the four photosensitive drums 51*a*, 51*b*, 51*c* and 51*d* and the belt driving roller 62 by the single motor M2 are shown in parts (a)-(c) of FIG. 9. Part (a) of FIG. 9 is the schematic view of entire driving gear train, part (b) of FIG. 9 is an extracted view, from part (a) of FIG. 9, of the gear train for driving the photosensitive drums 51*a*, 51*b*, 51*c* and 51*d*, and part (c) of FIG. 9 is an extracted view, from part (a) of FIG. 9, of the gear train for driving the belt pinion gear roller 62.

The drive transmission mechanism 120 includes the single motor M2, which is the driving source, and a pinion gear 121, which is a driving gear provided on an output shaft of the motor M2. The drive transmission mechanism 120 further includes a first idler gear 122, which is a first gear engaging with the pinion gear 121, and a plurality of gears, which are first drive transmission means for transmitting a driving force from the first idler gear 122 to the photosensitive drums 51. Further, the drive transmission mechanism 120 includes a second idler gear 130, which is a second gear engaging with the pinion gear 121, and a plurality of gears, which are second drive transmission means for transmitting a driving force from the second idler gear 130 to the belt driving roller 62.

First, the gear train for driving the photosensitive drums 51*a*, 51*b*, 51*c* and 51*d* will be described using part (b) of FIG. 9 and FIG. 10. The pinion gear 121 is mounted integrally with the output shaft of the motor M2. The first idler gear 122 engages with the pinion gear 121 and is freely rotatable relative to a rotation shaft 122*s*. Drum driving gears 124*a*, 124*b*, 124*c* and 124*d* are gears mounted integrally with the photosensitive drums 51*a*, 51*b*, 51*c* and 51*d*, respectively, shown in FIG. 8. The drum driving gears 124*a*, 124*b*, 124*c* and 124*d* engage with the first idler gear 122 through the plurality of gears.

Next, the gear train for driving the belt driving roller 62 will be described using part (c) of FIG. 9 and FIG. 10. The idler gear 130 engages with the pinion gear 121 and is freely rotatable relative to a rotation shaft 130*s*. Here, the idler gear 130 is identical in specifications such as the number of teeth and a module to those of the first idler gear 122 described above. Further, the rotation shaft 130*s* of the first idler gear 130 is disposed coaxially with the rotation shaft 122*s* of the first idler gear 122. A belt driving gear 131 is a gear provided integrally with the belt driving roller 62 as an object to be driven as shown in FIG. 8. The belt driving gear 131 engages with the second idler gear 130 through a plurality of gears.

As described above, the two gears consisting of the first idler gear 122 and the second idler gear 130 are provided coaxially with each other (122*s*, 130*s*) and engage with the pinion gear 121 mounted integrally with an output shaft of the motor M2. Here, the first idler gear 122, which is a first gear, is disposed closer to the motor M2 than the second idler gear 130, which is a second gear is.

For that reason, even in the case where the exposure-transfer distance changes due to an error in mounting position of the optical scanner 114, the influence of the rotation non-uniformity per rotation of the motor is satisfactorily absorbed, so that image defect such as image distortion due to the rotation non-uniformity can be prevented. Further, the rotation non-uniformity and the shock fluctuation caused by the load fluctuation of the feeding means can be prevented from transmitting to the drive of the photosensitive drums 51.

Here, as a shock fluctuation caused by the load fluctuation of the feeding means, it is possible to cite, for example, a shock when the recording material S enters or moves away from a nip formed between the intermediary transfer belt 60 and the secondary transfer roller 61 in the case where the recording material S passes through the nip, a shock due to a torque fluctuation caused by switching between the presence and absence of the toner on the intermediary transfer belt 60 in the primary transfer, and the like shock.

In this embodiment, the image forming apparatus of an intermediary transfer type was described, but the transfer type is not limited to the intermediary transfer type. For example, the present invention is also applicable to an image forming apparatus of a direct transfer type.

Here, an example of the image forming apparatus of the direct transfer type will be described using FIG. 11. FIG. 11 is a schematic view of an inside structure of an image forming apparatus C according to the embodiment 2.

The image forming apparatus C includes an apparatus main assembly 201 including four image forming portions. The image forming portions include photosensitive drums 151*a*, 151*b*, 151*c* and 151*d* and include process means (not shown) such as charging means and developing means. Further, toner images formed on the photosensitive drums are successively transferred superposedly onto the recording material S fed by a transfer belt 160, which is an endless belt, rotating while opposing the respective image forming portions. Thereafter, the recording material S on which the toner images are transferred is fed to the fixing means 9, and is heated and pressed by the fixing means 9, so that the toner images are fixed. Then, the recording material S on which the toner images are fixed is discharged to the outside discharge tray 13 by the discharging roller pair 12*a* and 12*b*. Incidentally, the transfer belt 160 is an endless belt stretched by a plurality of stretching members. The transfer belt 160 is rotationally driven by the belt driving roller 162, which is one of the stretching members, and is circulated and moved while opposing the image forming portions.

Here, while a constitution in which the transfer material is the recording material S and the feeding means is the belt driving roller 162 for rotating the transfer belt 160 is employed, the present invention is also equivalently applicable to the image forming apparatus of the direct transfer type, and it is possible to obtain an effect similar to the above-described effect.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2020-006953 filed on Jan. 20, 2020, which is hereby incorporated by reference herein in its entirety.

What is claimed is:

1. An image forming apparatus in which an image formed on an image bearing member is transferred onto a transfer material fed by feeding means, said image forming apparatus comprising:

a drive source;

a driving gear provided on an output shaft of said drive source;

a first gear engaging with said driving gear;

first drive transmission means configured to transmit a driving force from said first gear to said image bearing member;

a second gear engaging with said driving gear; and second drive transmission means configured to transmit a driving force from said second gear to said feeding means, wherein said first gear and said second gear are provided coaxially with each other, and wherein a positional relationship between said first gear and said second gear with respect to an axial direction is that said first gear is disposed closer to said drive source than said second gear is.

2. An image forming apparatus according to claim 1, wherein said first gear and said second gear are the same in number of teeth.

3. An image forming apparatus according to claim 1, wherein specifications of said first gear and said second gear are set so that a center distance between said output shaft and a rotation shaft of said first gear and a center distance between said output shaft and a rotation shaft of said second gear are equal to each other.

4. An image forming apparatus according to claim 1, wherein a latent image formed on said image bearing member at an exposure position is developed into a developer image and the developer image is transferred onto the transfer material at a transfer position, and wherein a distance from the exposure position to the transfer position satisfies the following relationship:

$$1/n1\times\theta/360\approx N1 \text{ (}N1\text{: natural number)},$$

wherein n1 represents a reduction ratio from the exposure position to the transfer position of said image bearing member, θ represents an angle (degrees) formed by a rectilinear line connecting a rotation center of said image bearing member and the exposure position and a rectilinear line connecting the rotation center and the transfer position, and N1 represents the distance from the exposure position to the transfer position and is an integer multiple of one-full circumference of said drive source.

5. An image forming apparatus according to claim 1, wherein said transfer material is a recording material onto which the image formed on said image bearing member is transferred.

6. An image forming apparatus according to claim 5, wherein said feeding means is a feeding roller provided upstream or downstream of a transfer position, where the image is transferred onto the recording material, with respect to a feeding direction of the recording material and configured to feed the recording material.

7. An image forming apparatus according to claim 5, wherein said feeding means is transporting means provided upstream of a transfer position, where the image is transferred onto the recording material, with respect to a feeding direction of the recording material and configured to transport the recording material, stacked on a stacking portion, to the transfer position.

8. An image forming apparatus according to claim 5, wherein said feeding means is fixing means provided downstream of a transfer position, where the image is transferred onto the recording material, with respect to a feeding direction of the recording material and configured to fix, on the recording material, the image transferred on the recording material at the transfer position.

9. An image forming apparatus according to claim 5, wherein said feeding means is an endless belt which is stretched by a plurality of stretching members and which is rotationally moved.

10. An image forming apparatus according to claim 1, further comprising an intermediary transfer member configured to once carry the image formed on said image bearing member, wherein the image is transferred from said intermediary transfer member onto the transfer material fed by said feeding means.

* * * * *